US006869084B2

(12) United States Patent
Volk et al.

(10) Patent No.: US 6,869,084 B2
(45) Date of Patent: Mar. 22, 2005

(54) DIGNIFIED BROAD FOOTPRINT BEACH WHEELCHAIR

(75) Inventors: Matthew Volk, Ardmore, PA (US); Holly Alderman, Bryn Mawr, PA (US); Karl-Rainer Blumenthal, Glenside, PA (US); Benjamin Cooperman, West Conshohocken, PA (US); Dana Henry, Media, PA (US); Lauren A. Herman, Bala Cynwyd, PA (US); Vincent L. Johnson, Philadelphia, PA (US); Tara M. Miller, Philadelphia, PA (US); Peter W. O'Keefe, Philadelphia, PA (US); Daniel Orlowitz, Melrose Park, PA (US); John S. Peet, Wyndmoor, PA (US); William E. Rouse, Philadelphia, PA (US); Victor W. Scarpato, Philadelphia, PA (US); Joshua Sperling, Philadelphia, PA (US); Jeffrey Suway, Rydal, PA (US); John Z. Zeglinski, Philadelphia, PA (US); Randy W. Granger, Sumneytown, PA (US)

(73) Assignee: William Penn Charter School, Philadelphia, PA (US)

( * ) Notice: Subject to any disclaimer, the term of this patent is extended or adjusted under 35 U.S.C. 154(b) by 0 days.

(21) Appl. No.: 10/442,465

(22) Filed: May 21, 2003

(65) Prior Publication Data

US 2003/0218310 A1 Nov. 27, 2003

Related U.S. Application Data

(60) Provisional application No. 60/382,513, filed on May 22, 2002.

(51) Int. Cl.[7] ..... B63B 35/02; B63H 16/00

(52) U.S. Cl. ..... 280/5.24; 280/250.1; 297/DIG. 4; 16/18 B

(58) Field of Search ..... 280/250.1, 304.1, 280/5.24, 5.3, 5.2, 5.32; 297/DIG. 4; 16/18 B

(56) References Cited

U.S. PATENT DOCUMENTS

| | | | | | |
|---|---|---|---|---|---|
| 3,239,872 | A | * | 3/1966 | Kitrell | 16/18 R |
| 4,132,423 | A | * | 1/1979 | Chant | 280/5.3 |
| 4,641,850 | A | * | 2/1987 | Rice et al. | 280/304.1 |
| 5,149,118 | A | * | 9/1992 | Oxford | 280/250.1 |
| 5,634,650 | A | * | 6/1997 | Hensler et al. | 280/47.38 |
| 5,983,452 | A | * | 11/1999 | McGovern | 16/42 R |
| 6,338,493 | B1 | * | 1/2002 | Wohlgemuth et al. | 280/30 |
| 2001/0007389 | A1 | * | 7/2001 | Frauwirth | 280/304.1 |

FOREIGN PATENT DOCUMENTS

| | | | | |
|---|---|---|---|---|
| DE | 29717423 U | * | 11/1997 | |
| DE | 19848294 A | * | 10/1999 | |
| FR | 2423212 A | * | 12/1979 | A47C/1/00 |
| GB | 2237250 A | * | 5/1991 | A61G/5/06 |
| JP | 07067919 A | * | 3/1995 | A61G/5/00 |

* cited by examiner

*Primary Examiner*—Kevin Hurley
(74) *Attorney, Agent, or Firm*—Andrew E. C. Merriam

(57) ABSTRACT

A wheelchair or a vehicle for sand or loose soil comprises one or more skids, each equipped with a spring-loaded roller or roller plate. Examples of the vehicle include a wheelchair and a planetary rover. Preferably, a beach, shower or pool wheelchair comprises two front skids in place of front wheels. The skids provide a resistance-free, broad footprint in the sand and a low-resistance narrow footprint when used on hard, e.g. boardwalk, surfaces. A wheelchair may further comprise a lightweight, easy to fold frame, which closes like a pair of eyeglasses. Still further, a wheelchair may provide a removable and reclining lounge chair seat to allow the user to exit the wheelchair to enter the water or sit and recline on the sand. In addition, dog bone or dumbbell shaped wheels provide the wheelchair strong, lightweight support and a wide footprint and can be equipped with grip notches for user self-propulsion. The inventive wheelchair provides the user with a combination of improvements, which respect the user's grace and dignity.

16 Claims, 4 Drawing Sheets

DIGNIFIED BROAD FOOTPRINT BEACH WHEELCHAIR

This application claims priority to Provisional Patent Application No. 60/382,513 filed on May 22, 2002.

FIELD OF THE INVENTION

The present invention relates to a vehicle for sand, loose soil or soft terrain equipped with a skid comprising a spring-loaded roller. In particular, the present invention provides a foldable beach wheelchair having a removable seat and two front skids, each comprising a spring-loaded roller or a removable roller plate which provide a low-resistance, broad footprint on the sand and a narrow, low resistance footprint on pavement, boardwalk or hard ground.

BACKGROUND OF THE INVENTION

With very limited success, wheelchairs have been adapted to access areas requiring travel over soft terrain, such as sand, loose soil and gravel. Attempts at designing beach wheelchairs, in particular those described in U.S. Pat. No. 4,641,850, to Rice et al., provided removable wide metal bands surrounding the propulsion wheels of the wheelchair so as to keep the wheels from sinking in the sand. However, such beach wheelchairs and their additional parts would invariably sink into the sand and get fouled and the metal in such chairs would corrode in the salt air. Further, the front wheels or casters would sink into the sand anyway, dragging the user and her dignity down with them. Still further, once the user accessed the beach, she still had to negotiate her way into and out of the water by exiting and then re-entering the wheelchair.

Compounding the indignity caused by immobile, corrosable and easily fouled beach wheelchairs, existing beach wheelchairs fold like an accordion and their frames often start folding on their own during the user's struggle to travel on the sand. The wheelchairs thus fail to support the user properly and can thereby cause muscle and back strain. As if this were not enough indignity, the seating materials of existing beach wheelchairs do not breathe and can cause chafing and discomfort.

A recent low pressure tire design, described in U.S. Pat. No. 6,279,631, to Tuggle, provides a fairly inelastic low pressure tire material for a beach wheelchair that can flatten under load to ease movement over soft surfaces. However, the low pressure tire concept does not solve the problem of fouling or corrosion and does not address the problem caused when any tires, front or rear, sink in the sand. Further, the low-pressure tire concept does not address the need to provide an easy to fold wheelchair that does not fail to support the user when in use. Still further, no seat materials are taught or suggested which prevent chafing and irritation to the user.

There remains great and long felt demand for a wheelchair that allows easy travel over soft ground and sand and which will not corrode in the salt air. As well, wheelchair users continue to desire comfortable seat materials that breathe. Still further, an easy to fold, lightweight wheelchair frame would enhance ease of use in comparison to existing accordion-style folding beach wheelchairs. Finally, wheelchair users still lack for a beach wheelchair that allows easy exit and re-entry to permit them to get on the beach or enter the water. Accordingly, the present inventors have sought to provide a wheelchair that solves the aforementioned problems while respecting the user's dignity.

SUMMARY OF THE INVENTION

The present invention provides a wheelchair comprising a seat, two rear wheels, two front skids and a frame onto which each of the seat, wheels and skids are mounted. Each front skid on the wheelchair comprises a skid body having within it a spring-loaded roller or a removable roller plate on which the wheelchair rests, creating little resistance while the wheelchair rolls on pavement or hard ground. In addition, the skid body provides a broad footprint to decrease resistance and to prevent sinking in sand, soft terrain or loose soil. Spring tension keeps the roller tight in its socket to prevent sand or soil penetration into the roller and consequent fouling. The roller plate edge may or may not be flush with the bottom surface or the skid and the roller plate and roller may be interchangeable. Further, dumbbell or dog bone shaped rear wheels provide a wide footprint and the wheels and frame of the wheelchair are constructed of a lightweight, corrosion proof material. Still further, a removable, reclining seat supports the full length of the wheelchair user's legs with a comfortable porous film material and allows for easy exit and re-entry. Accordingly, the present invention provides a highly mobile and dignified beach wheelchair.

A wheelchair frame and wheels maybe made of lightweight hollow material, such as rotationally or hollow molded or cast polyvinyl chloride (PVC) or high density polyethylene (HDPE), with or without fiber or mesh reinforcement, wherein the hollow material may be foam filled to provide a floatable pool wheelchair.

The present invention further provides a wheelchair frame comprising side wings that fold inwardly against said back rest support, wherein each side wing may be equipped with one or more than one slidable ledger disposed horizontally under the seat, for example, under the seat at or above the user's knee, such as under the thigh above the knee, to support seats having variable widths. Further, by sliding outwardly as the side wings fold inwardly, the ledgers allow the side wings to fold without obstruction against the inside of the back of the wheelchair frame. The side wings may further have a hinge stop that causes the wings to lock against the back rest support and allows the wings to fold and unfold with a flipping action, like the arms of a pair of eyeglasses.

The present invention still further provides a skid comprising a spring-loaded roller or removable roller plate that may be used on soft terrain, loose soil, sand or mud, for example, in place of wheels on a planetary rover or any vehicle which should have a steady, wide footprint, such as a walker or a water walker for pool therapy.

DETAILED DESCRIPTION OF THE INVENTION

A broad footprint beach wheelchair in accordance with a preferred embodiment of the present invention includes several inventive improvements over the current state of the art. For example, a skid having a spring-loaded roller or removable roller plate comprises an improvement in wheelchair design, but is also inventive in its own right. The several drawing figures assist in describing some of the advantages of the present invention.

All ranges cited herein are inclusive and combinable.

As used herein, the term "roller plate" refers to a plate attachable to the bottom of a skid, as well as detachable therefrom, and providing a roller footprint.

Any off-the shelf beach seat that fits onto the wheelchair frame may be used, such as one having an aluminum tube frame. As the one or more than one slidable ledger in each side wing of the wheelchair frame can accommodate any size or width of commercially available beach seat, any such seat may be used and the seat may or may not comprise an adjustable leg rest. The adaptable wheelchair frame and the off-the shelf beach seat may therefore be used with a custom seat to provide a shower wheelchair.

Figure 1A:
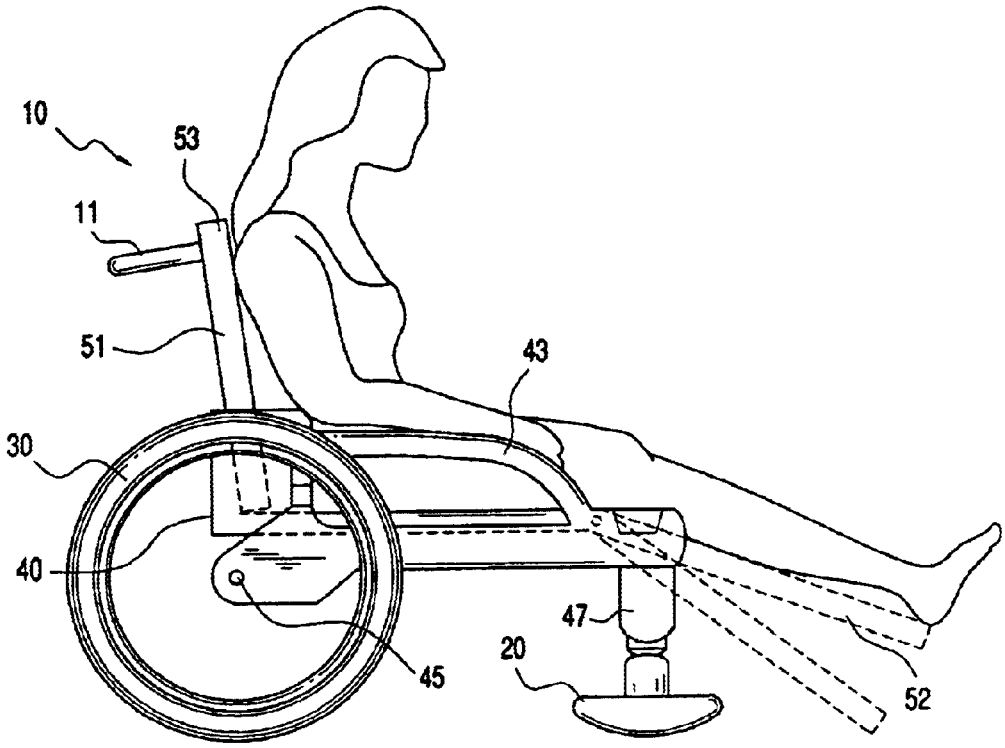
FIG. 1*a* depicts an exemplary use of a beach wheelchair in accordance with the present invention.

A removable seat 53 that supports the full length of a wheelchair user's body is shown in FIG. 1*a*. The horizontal section of seat 53 extends all the way to a user's knee and supports the full upper portion of the user's leg, unlike previous seats which cut off above the knee. Seat 53 comprises leg rest 52 and back rest 51. Leg rest 52 and back rest 51 may each be adjustable using a conventional ratcheting mechanism (not shown) found in beach chairs. Leg rest 52 provides support of the full length of a user's legs. Seat 53 may also have supports or legs (not shown) which fold under the horizontal section of seat so as not to interfere with frame 40.

Figure 1B:
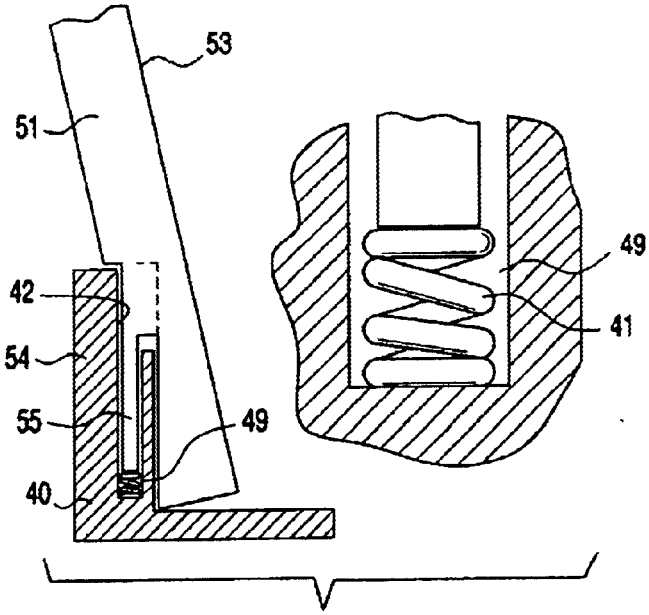
FIG. 1*b* depicts an embodiment of a seat attachment to a wheelchair frame and an exploded view of the spring support for a seat in accordance with the present invention.
Figure 1C:
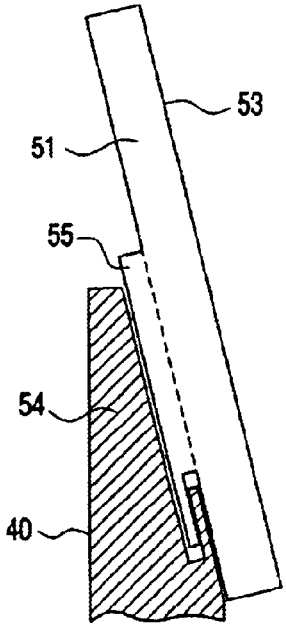
FIG. 1*c* depicts another embodiment of a seat attachment to a wheelchair frame in accordance with the present invention.
Figure 5:
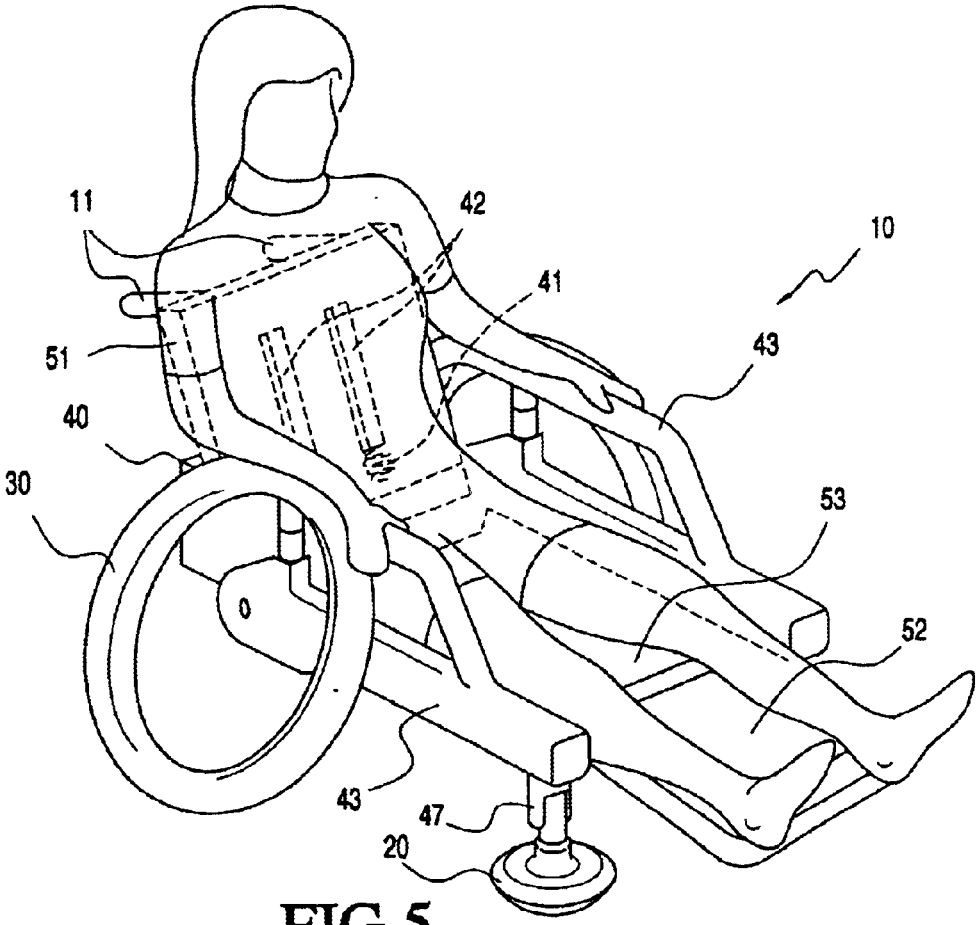
FIG. 5 depicts an embodiment of the seat of a beach wheelchair in accordance with the present invention.

As shown in FIGS. 1*b* and 1*c*, seat back rest 51 conforms to and may attach removably to back rest support 54 of the frame 40 via the seat frame itself (FIG. 1*b*) or via two vertical attachment members 55 (FIG. 1*c*) which are part of the frame of the seat. The vertical attachment members 55 of back rest 51 may slide or key into female attachment slots 42 (FIGS. 1*b* and 5) located in the front side of back rest support 54. Members 55 and slots 42 preferably are shaped, respectively, like male and female right triangular prisms or cylinders of the same size, and can comprise other shapes. Preferably, as shown in FIG. 1*c*, back rest support 54 is angled so that back rest 51 and support 54 align in a parallel fashion to ease attachment. As shown in FIG. 1*b*, members 55 allow seat 53 to rest on high-K value springs 41 located in spring sockets 49 disposed at the bottom of each of slots 42. The springs 41 cushion the user against shocks and are preferably constructed of vesconite (polyethylene terephthalate engineering thermoplastic, Vesco Plastics Sales (Pty.) Ltd.) to resist abrasion and wear.

Alternatively, a removable seat may attach to a wheelchair frame via two or more supports (not shown) attached on the inside of each side wing. Supports for seat should conform to the frame of a seat's leg rest, so that, for example, supports may comprise j-bends for round tubular, rod or cylindrical seat frames or L-bends for square tubular frames. Supports should be spaced apart so that one support is adjacent the back end of a seat leg rest and has a bullet catch or spring loaded catch to allow the seat to snap fittingly in place, i.e. a "snapfit."

To make a fully static seat support, seat 53 may rest on one or more than one seating rail, rod, cylinder or contoured ledger (not shown), which is part of each of the side wings 43 (FIG. 2*a*) of the wheelchair frame 40. The ledger may be beveled to receive the round tubing of a seat frame, may have a squared upper surface to receive a square tube seat frame or may be equipped with a pinhole or pin which matches, respectively, to a corresponding pin or pinhole in a seat frame. Ledger may also be beveled to accommodate any legs or supports for seat 53 which fold underneath the seat.

In another embodiment, ledger should be slidable, for example, attached through an aperture in each side wing to allow each side wing to fold inwardly against back rest support, for example support 54 (FIG. 1*b*) of frame 40. A slidable ledger may have a flat circumferential lip or flange at each end to keep it attached with a side wing, so that the lip or flange closes flush with the surface of the side wing.

Because seat 53 supports the full length of a user's body and because the beach wheelchair 10 can be preferably made of a moisture resistant, non-corrosable material, such as hollow or rotationally molded or cast PVC or HDPE, with or without fiber or fiber mesh reinforcement and/or foam filing, a user can easily exit and re-enter wheelchair 10. The user may do this, for example, by lowering leg support 52, and slipping off and then back on the chair using the full length of seat 53. In a floatable wheelchair, a user may enter the water prior to exiting the chair and then swim out of and back into the chair.

By virtue of a support system which relies on the force of gravity and weight, seat 53 can easily be removed by a user simply by lifting it out of attachment slots 42 or snap fits, for example, by lifting the two seat handles 11. Once removed, seat 53 can recline just like an ordinary beach chair.

Seat 53 is preferably made from a porous film material like porous nylon, porous HDPE or porous Novex (LDPE or low density polyethylene, BP/Amoco), may include woven web materials such as polyesters, and may include polyurethane padding disposed between two layers of the film. "Film" as used herein includes single and multi-layer films as well as sized films.

Figure 2A:
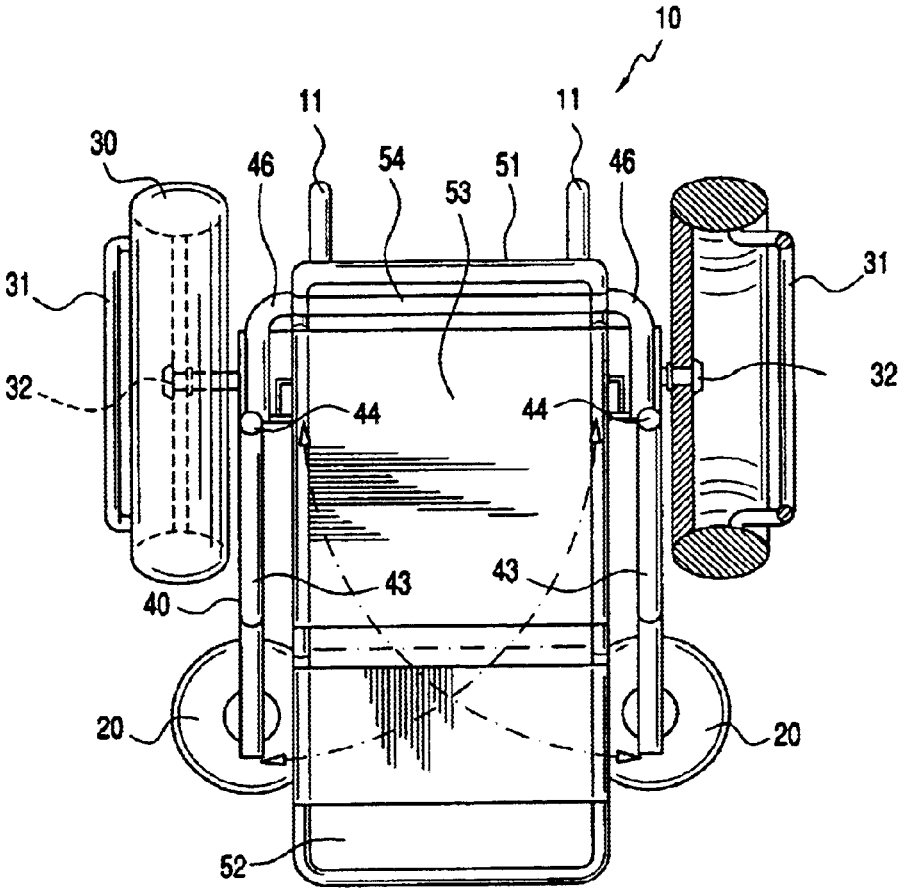
FIG. 2*a* depicts a top view of an embodiment of a wheelchair comprising a frame having a contoured back rest support and pivotally mounted side wings in accordance with the present invention.
Figure 2B:
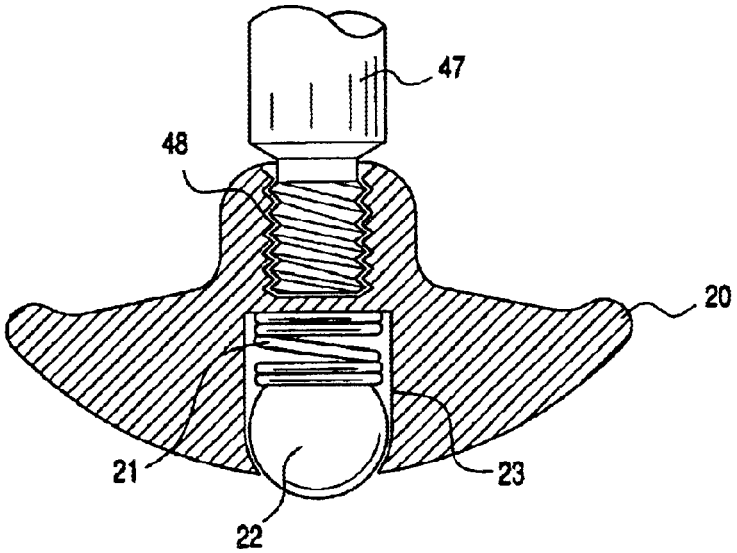
FIG. 2*b* depicts an embodiment of a skid in accordance with the present invention.

As shown in FIG. 2*b*, a skid comprises a skid body 20 having a socket 23 for receiving a spring 21 and a roller 22 or a skid body may comprise a roller plate (not shown). Roller 22 is disposed within said socket 23 and beneath said spring 21 and preferably comprises a ball. Spring tension keeps a roller tight in the sockets to eliminate sand penetration and subsequent abrasion. In a roller plate (not shown), a roller may be spring loaded or may float on bearings housed inside a recess in a plate adapted to receive the roller. Socket 23 need not be absolutely vertical, however it should be disposed so that the weight of the wheelchair 10 creates sufficient spring tension to force roller 22 to protrude from beneath skid body 20 so as to bear the weight of wheelchair 10. Preferably, socket 23 is disposed in skid body 20 in a wheelchair 10 or other vehicle at an angle within about 10 degrees of vertical. Socket 23 may have a lip at its flange to assist in cleaning off roller 22 as it passes into skid body 20 and should have an opening at the bottom of skid body 20 that is small enough in diameter that roller 22 cannot fall out of skid body 20.

When a skid body has a roller plate, the roller plate may be interchangeable with a roller. The roller plate may screw in flush to the bottom of the skid body or may snap fit securely into a recess in the skid body adapted to receive the roller plate, such as via two or more than two spring loaded ball bearings, rollers or bullet catches in the roller plate. Similarly, the spring loaded catches, for example, may be a part of a recess in the skid body into which fits securely a lip, flange or tab of the roller plate.

As shown in FIG. 1*a*, skid body 20 provides the front footprint or footprints of wheelchair 10. Roller 22 or a skid plate (not shown) may provide the front footprint of said wheelchair on improved or hard ground, such as on pavement, concrete, boardwalk and the like. The "footprint" of a skid is defined by the width of that portion of the skid that touches the ground. Skid body 20 itself bears the weight of the wheelchair on sand, loose soil and mud and provides a broad footprint that is from about 4 inches wide to about 10 inches wide so as to provide a broad footprint without interfering with a user's feet, for example, from 6 to 9 inches wide. A skid body may have a hemispherical bottom, an ellipsoid bottom or a continuously rounded bottom having a wide radius of curvature of about 2 feet to about 4 feet, as shown in FIG. 2*b*.

To insure proper weight distribution, the ratio of the width or diameter of skid body to the width or diameter of a roller plate should range from 6:1 to 1.1:1, and the ratio of the width or diameter of skid body to the width or diameter of a roller, including a roller in a roller plate should range from 12:1 to 1.2:1.

Each skid body 20 attaches to frame 40 (FIG. 1*a*) via a front leg 47 of wheelchair 10. Front leg 47 may be threaded to receive skid body 20 which may comprise female socket 48 (FIG. 2*b*) for receiving each leg 47. Alternatively, each front leg 47 may comprise a caster attachment, a circumferential lip extending sideways at its end, or spring loaded retractable bearings, wherein the attachment, lip or bearings snap securely into a recess in female socket 48. Female socket 48 may itself be threaded, or may comprise a socket having a ring-shaped recess at its bottom to receive a snap ring or retractable bearings from front leg 47. Similarly, skid body 20 may comprise a male member (not shown), like front leg 47, which fits securely into a female socket (not shown) in front leg 47.

Skid body 20 may be made from a friction resistant material chosen from polytetrafluoroethylene (PTFE), polyoxymethylene (POM), POM-co-(meth)acrylate, POM-(meth)acrylate block copolymers, PTFE coated aluminum, PTFE coated magnesium alloy, and PTFE-coated thermoplastic polymer, such as PTFE coated PVC. PTFE is the preferred material for skid body 20. "Aluminum" as used herein includes cast and anodized aluminum.

Roller plates, rollers, springs, supports, ledgers, screws and hardware and any bushing or spring loaded catch may be constructed of, or may be coated or laminated with one or more film of vesconite (polyethylene terephthalate based engineering thermoplastic from Vesco Plastics Sales (Pty.) Ltd.), polyacetals, aromatic polycarbonates, and copolymers thereof, or stainless steel to resist abrasion and wear.

Figure 4:
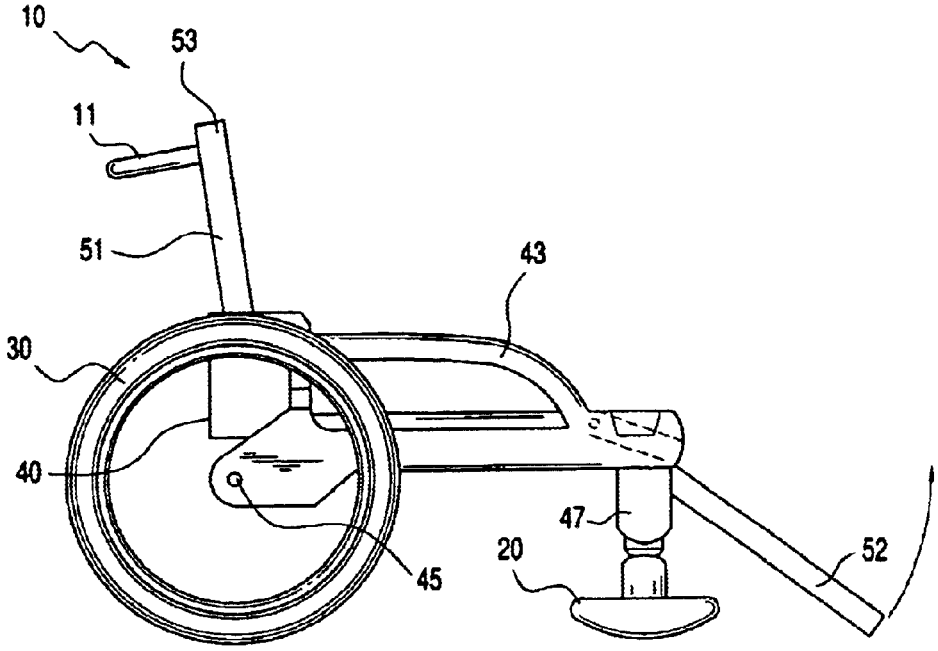
FIG. 4 depicts a side view of an embodiment of a beach wheelchair in accordance with the present invention.

In another embodiment of the present invention, as shown in FIG. 2*a*, wheelchair frame 40 comprises a back rest support 54, contours 46 on each side which circumscribe an arc of about 90 degrees, mounts or pivot attachments 44 for frame side wings 43, mounts 45 (FIG. 4) for rear wheels 30 and legs 47 having screw threads for attachment of each skid body 20 to frame 40. Frame 40 preferably comprises a contoured back rest support 54 which fits the curve of a users back and hips. Frame side wings 43, are hinged or pivotally attached at wing pivot 44 to back rest support 54, and are adapted to fold inwardly against said back rest support once seat 53 and wheels 30 are removed from frame 40. Wing pivot 44 may comprise a female hole in frame 40, usually located in the top of contour 46 and adapted to receive a pin (not shown) contained in each side wing 43. The pinhole may be offset slightly inboard or rearward from frame 40 along the top of frame contour 46 to prevent the frame from hindering the folding of side wings 43. Preferably side wings 43 are mounted via an eccentric or hinge stop that allows them to fold into or away from back rest support 40 with a snap much in the same way as the two stems or arms of a pair of eyeglasses fold against and away from the lenses.

In another embodiment of the invention, as shown in FIG. 2*a*, pin 32 located on each wheel 30 mounts releasably into wheel mount holes 45 located on each side wing 43 of frame 40. Holes 45 preferably are slightly widened at their base to accommodate bearings from pin 32 which is preferably a quick release pin. A preferred quick release attachment for wheels 30 to frame 40 comprises a mushroom capped pin which when pressed retracts bearings which are used to hold the pin in hole 45. An example of a pin suitable for use in the present invention is a quick release axle made by Alco Sales & Service Co, Burr Ridge, Ill.

Figure 3A:
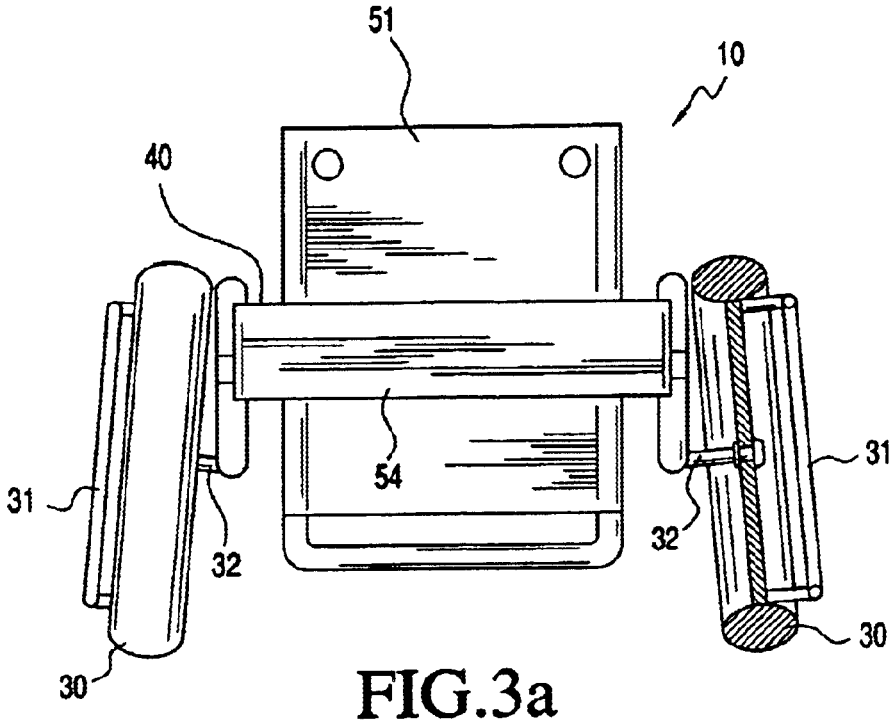
FIG. 3*a* depicts a rear view of an embodiment of a beach wheelchair in accordance with the present invention.
Figure 3B:
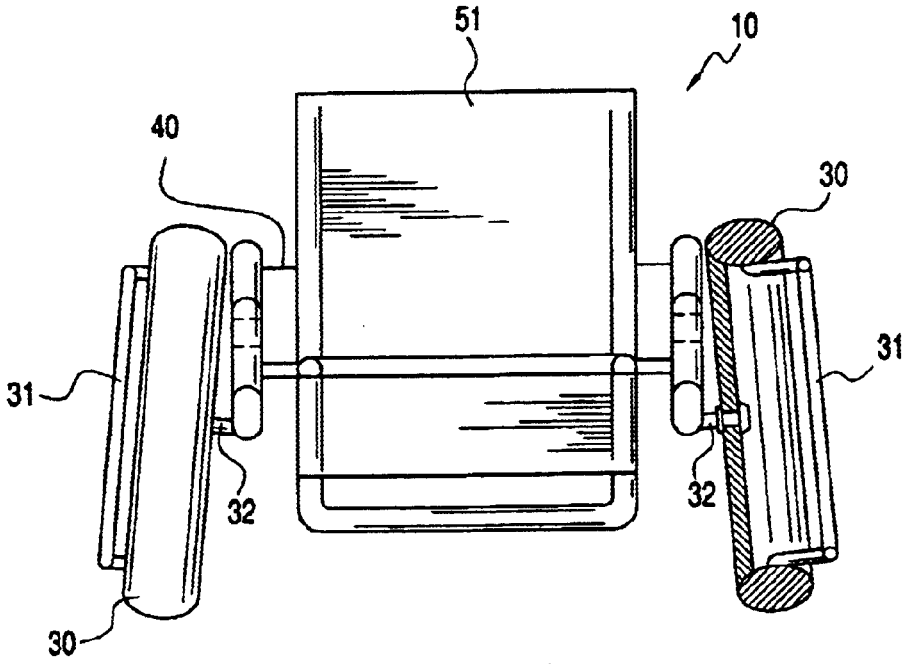
FIG. 3*b* depicts a front view of an embodiment of a beach wheelchair in accordance with the present invention.

As shown in FIGS. 3*a* and 3*b*, wheels 30 have a dog bone diametrical cross-section which allows for lightweight while providing a wide footprint in loose soil or sand. The width of the tire or that portion of the wheel or ball that touches the ground defines the "footprint" of a wheel or ball. The footprint of wheels 30 may range from about 3 ½ to about 6 inches wide, and is preferably about 5 inches wide. The footprint should not be so narrow as to allow the wheelchair to sink into loose soil or sand and should not be so wide as to make it difficult for the user to reach the wheel grip 31 located on the outside of wheel 30. Wheels 30 can be cambered as shown in the figure, but are preferably disposed normal (90° angle) to the ground so that a wheelchair user may access stalls in public restrooms.

In a preferred embodiment of the present invention, wheels comprise conventional grip notches 31 for user self propulsion. Grip notches 31 may comprise a ring-shaped hand rail having finger-sized rounded indentations in it, or may comprise from about 3 to about 8 grip handles periodically spaced flush or nearly flush with the tread of the wheel on the outer portion of wheel 30. Grip notches 31 may be mounted on each wheel 30, for example, with sheet metal screws set into nylon split grommets which are placed in the wheel.

To maintain light weight and prevent corrosion, frame 40 and wheels 30 may be constructed of ¼" hollow molded, rotationally molded or cast PVC or HDPE, optionally with fiber or fiber web or mesh reinforcement. Frame and wheels may also be foam filled to provide a floating wheelchair suitable for use as a pool wheelchair. Alternatively, frame 40 and wheels 30 may be constructed of cast aluminum or magnesium alloy. However, the aluminum may not be adequately moisture resistant.

Unless otherwise specified, in making the beach wheelchair of the present invention, conventional bearings, springs, bushings and hardware can be used in a conventional manner. All supports, ledgers, bearings, bushings and rollers which contact moving parts may be constructed of vesconite (engineering thermoplastic), polyacetals, aromatic polycarbonates, and copolymers thereof, as well as stainless steel to resist abrasion and wear.

In an alternative embodiment of the present invention, one or two or more spring-loaded roller skids may be provided in a vehicle other than a wheelchair. When used in other vehicles, the spring-loaded roller skids function much in the same way that they do in a wheelchair. The roller is disposed within a socket and beneath the spring such that the weight of the vehicle creates spring tension forcing the roller to protrude from beneath the body of the skid so as to bear the weight of the vehicle. The roller provides a footprint on improved or hard ground, whereas wherein said skid bears the weight of the vehicle on sand, loose soil and mud.

In use, the spring-loaded roller or roller plate skid may be attached to any vehicle in the place of any non-propulsion wheel, i.e. not propelled by pedaling, by hand or by attachment to a drive train, such as the front wheel or wheels of any rear-wheel drive vehicle. For added stability, one or two or more skids may also be used in addition to wheels, e.g. they may be used for training to ride a bicycle. A skid according to the present invention may be attached to a vehicle frame via a threaded socket, a quick release pin, an axle, or any means commonly used for attaching wheels that are not drive wheels to wheelchairs, bicycles and automobiles. The only limitation on the attachment of the skid to the frame of a vehicle is that the attachment must allow the skid to bear the weight of the vehicle on the roller or the roller plate. In accordance with this embodiment of the present invention, the vehicle may be a planetary rover or craft, an all terrain vehicle (ATV), including three wheel and four wheel ATV's, a mobile home, a trailer, such as a boat trailer, a mountain bike, a bicycle trailer, a walker or a water walker and a motorcycle side car.

We claim:

1. A wheelchair comprising a seat, two rear wheels, one or more front skids and a frame onto which each of said seat, wheels and skids are mounted, wherein each of said one or more front skids comprises a skid body having within it a spring-loaded roller or roller plate.

2. A wheelchair in accordance with claim 1, wherein said frame comprises a lightweight, hollow material.

3. A wheelchair in accordance with claim 1, wherein said skid body comprises a socket for receiving said spring and said roller, wherein said roller is disposed within said socket and beneath said spring such that the weight of said wheelchair creates spring tension forcing said roller to protrude from beneath said skid body so as to bear the weight of said wheelchair.

4. A wheelchair in accordance with claim 1, wherein said roller or roller plate provides a footprint of said wheelchair on improved or hard ground.

5. A wheelchair in accordance with claim 1, wherein said skid bears the weight of said wheelchair on sand, loose soil and mud.

6. A wheelchair in accordance with claim 1, wherein said wheelchair is a wheelchair comprising non-corrosable material or is a floatable wheelchair.

7. A wheelchair in accordance with claim 1, wherein said skid body comprises a friction resistant material.

8. A wheelchair in accordance with claim 5, wherein said skid provides a footprint that is from about 5 inches wide to about 10 inches wide.

9. A wheelchair in accordance with claim 1, wherein said frame comprises a back rest support and side wings pivotally attached to said back rest support such that said side wings fold inwardly against said back rest support.

10. A wheelchair in accordance with claim 6, wherein said frame comprises a back rest support and side wings, and further wherein said seat is mounted onto said frame via vertical slots in said back rest support or via supports attached to each side wing and conforming to the underside of the frame of said seat and rests on a slidable ledger in the side wings of said frame such that said seat can be removed from said wheelchair by lifting it out of said frame.

11. A wheelchair in accordance with claim 1, wherein said seat extends such that the full length of a user's upper legs can be supported thereon and said seat comprises an adjustable leg rest such that the full length of a user's legs can be supported thereon.

12. A wheelchair in accordance with claim 1 wherein said wheels have a dog bone diametrical cross-section, and further wherein the footprint of said wheels is from about 3½ to about 6 inches wide.

13. A wheelchair in accordance with claim 1 wherein said frame and said wheels are constructed of polyvinyl chloride (PVC).

14. A wheelchair in accordance with claim 12 wherein said wheels further comprise grip notches for user self propulsion.

15. A wheelchair comprising a seat, two rear wheels made of a lightweight hollow material, one or more front skids and a frame made of a lightweight hollow material onto which each of said seat, wheels and skids are mounted, wherein the said wheels further comprise grip notches for user self propulsion.

16. A wheelchair as claimed in claim 15, wherein the said frame and the said wheels comprise hollow PVC or HDPE (high density polyethylene), or comprise a foam filled material such that the wheelchair is floatable.

* * * * *